US009534419B2

(12) United States Patent
Schrader

(10) Patent No.: US 9,534,419 B2
(45) **Date of Patent: *Jan. 3, 2017**

(54) DECORATIVE DOOR HANDLE

(71) Applicant: Robert J. Schrader, Belleville, IL (US)

(72) Inventor: Robert J. Schrader, Belleville, IL (US)

( * ) Notice: Subject to any disclaimer, the term of this patent is extended or adjusted under 35 U.S.C. 154(b) by 143 days.

This patent is subject to a terminal disclaimer.

(21) Appl. No.: 14/121,147

(22) Filed: Aug. 6, 2014

(65) Prior Publication Data

US 2016/0040451 A1 Feb. 11, 2016

Related U.S. Application Data

(63) Continuation-in-part of application No. 13/998,274, filed on Oct. 17, 2013, now Pat. No. 8,918,962.

(60) Provisional application No. 61/864,170, filed on Aug. 9, 2013, provisional application No. 61/719,785, filed on Oct. 29, 2010.

(51) Int. Cl.

| | |
|---|---|
| ***A45C 3/00*** | (2006.01) |
| ***E05B 1/00*** | (2006.01) |
| ***E05B 15/16*** | (2006.01) |

(52) U.S. Cl.

CPC ..... *E05B 1/0015* (2013.01); *E05B 15/1607* (2013.01)

(58) Field of Classification Search

CPC ..... E05B 15/1607
USPC ..... D7/393
See application file for complete search history.

(56) References Cited

U.S. PATENT DOCUMENTS

| | | | | |
|---|---|---|---|---|
| 2,731,663 | A | 1/1956 | Thompson | |
| 2,765,550 | A * | 10/1956 | De Angelis | D06F 75/34 38/92 |
| 4,134,480 | A | 1/1979 | Davis | |
| 5,675,867 | A * | 10/1997 | Howie, Jr. | A47B 95/02 16/412 |
| 6,895,635 | B2 | 5/2005 | Tisol, Jr. et al. | |
| 6,954,967 | B2 | 10/2005 | Park et al. | |
| 8,918,962 | B2 * | 12/2014 | Schrader | E05B 1/0015 16/412 |
| 2003/0066614 | A1 * | 4/2003 | Sun | E06B 9/264 160/107 |
| 2003/0182762 | A1 | 10/2003 | Koops et al. | |
| 2008/0086843 | A1 | 4/2008 | Lee et al. | |
| 2009/0151503 | A1 | 6/2009 | Stafford, Jr. | |
| 2010/0205780 | A1 | 8/2010 | Ieda et al. | |
| 2014/0223697 | A1 * | 8/2014 | Draeger | E05D 5/04 24/303 |

* cited by examiner

*Primary Examiner* — Victor Batson
*Assistant Examiner* — Matthew Sullivan
(74) *Attorney, Agent, or Firm* — Paul M. Denk

(57) ABSTRACT

A decorative door handle comprising a flexible material configured in the shape of a door handle and a malleable stiffener material to maintain the handle in a desired useful looking configuration. In one aspect the flexible material is a magnetic vinyl. In another aspect, a decorative door handle comprising molded resin having at least one magnetic insert in the back surface. In another aspect, a decorative hinge element comprising molded resin having at least one magnetic insert in the back surface.

8 Claims, 4 Drawing Sheets

DECORATIVE DOOR HANDLE

CROSS REFERENCE TO RELATED APPLICATION

This non-provisional patent application claims priority to the provisional patent application having Ser. No. 61/864,170, filed on Aug. 9, 2013; and this application claims priority as a continuation application to the non provisional patent application having Ser. No. 13/998,274, filed on Oct. 17, 2013, and which latter application claims priority to its provisional patent application having Ser. No. 61/719,785, filed on Oct. 29, 2012.

BACKGROUND OF THE INVENTION

The invention relates generally to decorative door handles and, more particularly, to a decorative door handle that has a more realistic appearance than those currently known in the art.

This invention also relates generally to a decorative door hinge, and, more particularly, to a hinge that has a more realistic appearance, albeit of a nonfunctional characteristic, than any currently known in the art.

Many houses have doors that face the street, such as garage doors or insulated storm doors. Most of these doors are metal clad and plain in appearance. To dress up the door and make them more aesthetically pleasing, the homeowner may apply decorative hinges and handles of a contrasting color. For example, the homeowner may include decorative black hinges or handles on a white door. If the homeowner installs the decorative hinges or handle with attachment means, such as screws that require drilling into the metal door, the integrity of the door is ruined. Moisture can enter through the screw holds. Moreover, drilling holes into the metal door can void the warranty.

Magnetic decorative hinges and handles are known. However, in the case of the handles, the known expedients generally lay flat against the door and lack depth. The handles do not look functional or real and hence are not aesthetically pleasing. It would be advantageous to have a decorative hinge that can be formed to have a real or functional appearance.

SUMMARY OF THE INVENTION

In one aspect, a decorative magnetic handle is formed from a flexible sheet of magnetic material. The magnetic material can be cut or otherwise formed in any desired configuration or design to have the appearance of a door handle. In one aspect there is a malleable stiffener applied to at least a section of the magnetic vinyl material. The stiffener can be bent or otherwise manipulated to form a raised gripping area. The magnetic handle is placed on the surface of the metal door. The snug magnetic bond between the handle and the door effectively holds the handle in place. The raised gripping area gives the handle the appearance of a real, functional handle and adds to the aesthetically pleasing look of the handle.

In another aspect, a uniquely designed hinge, having highly aesthetic appearance, can be formed having selectively located magnets, in order to allow the hinge to be promptly secured to the metal or metal clad door, to add to its pleasing appearance of the door, of such hinges, and to any observer.

In another aspect, the handle can be constructed from a flexible material and have a stiffening component but is attached to the door by use of attachment means such as glue, epoxy, tape and so forth.

In another aspect, the handle can be molded from a durable resin material and provided with a raised gripping area. The resin handle can have at least one, and preferably at least two magnetic inserts, one at each end, to secure the handle to a metal door.

In yet another aspect, a decorative hinge can be molded from a durable resin material and can include at least one, and preferably two or more magnetic inserts along its length, for example one at each end and one in the middle, to secure the hinge to the surface of the metal door.

In another aspect, a method of making the decorative handle or decorative hinge with the magnetic inserts is disclosed.

DETAILED DESCRIPTION

Figure 1:
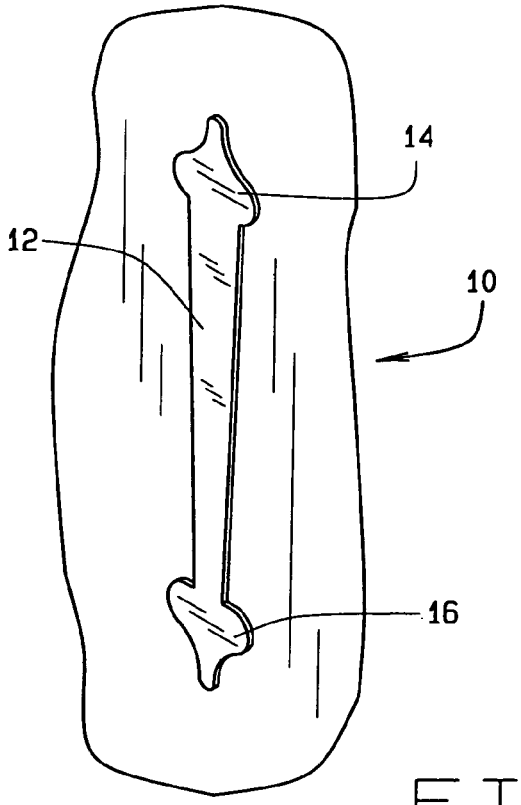
FIG. 1 PRIOR ART
FIG. 1 is a perspective view of a prior art decorative magnetic handle on a metal clad garage door.

FIG. 1 shows a prior art decorative magnetic handle, indicated by number 10, position on the outer surface of a metal clad garage door D. It will be noted that handle 10 is orientated such that its longitudinal axis is vertically orientated, however, it may be attached to a door with its longitudinal axis extending laterally. Handle 10 generally has a central gripping portion 12 and a first decorative element 14 at the top and a second decorative element 16 at the bottom end. In the illustrated prior art, the decorative elements are spade shaped. As seen, handle 10 is flat against the surface of door D and lacks depth and realism.

Figure 2:
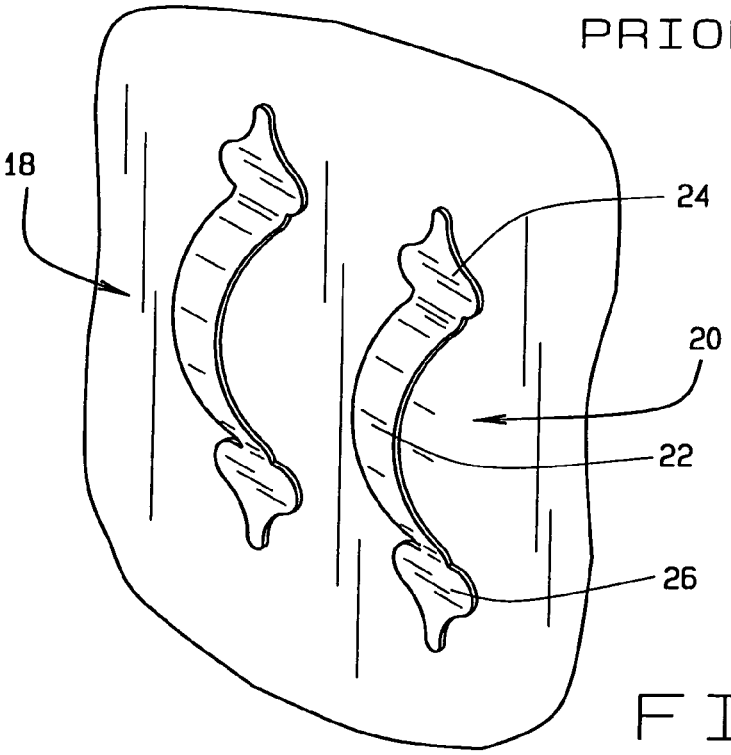
FIG. 2 is a perspective view of a pair of decorative handles of the present invention on a metal clad garage door.

FIG. 2 shows a pair of decorative handles of the present invention, indicated by numbers 18 and 20. The two handles are identical in configuration, having a gripping section 22, and first spade shaped decorative end element 24 at the top and a second spade shaped decorative element 26 at the bottom of the gripping section. It will be understood that the handle configurations are illustrative of one aesthetically pleasing configuration and that any configuration of decorative elements may be employed.

As noted, the gripping sections 22 are raised curves or arches. This arched configuration keeps the gripping section raised or elevated from the plane of the door and gives the handle a realistic, utilitarian look. The raised gripping section gives the appearance that a user could grasp the handle in a functional manner. It will be understood that the arched or curved configuration of the gripping section is but one choice. The gripping area could have sharp bends and appear essentially rectangular or to any other desired three dimensional configuration.

Figure 3:
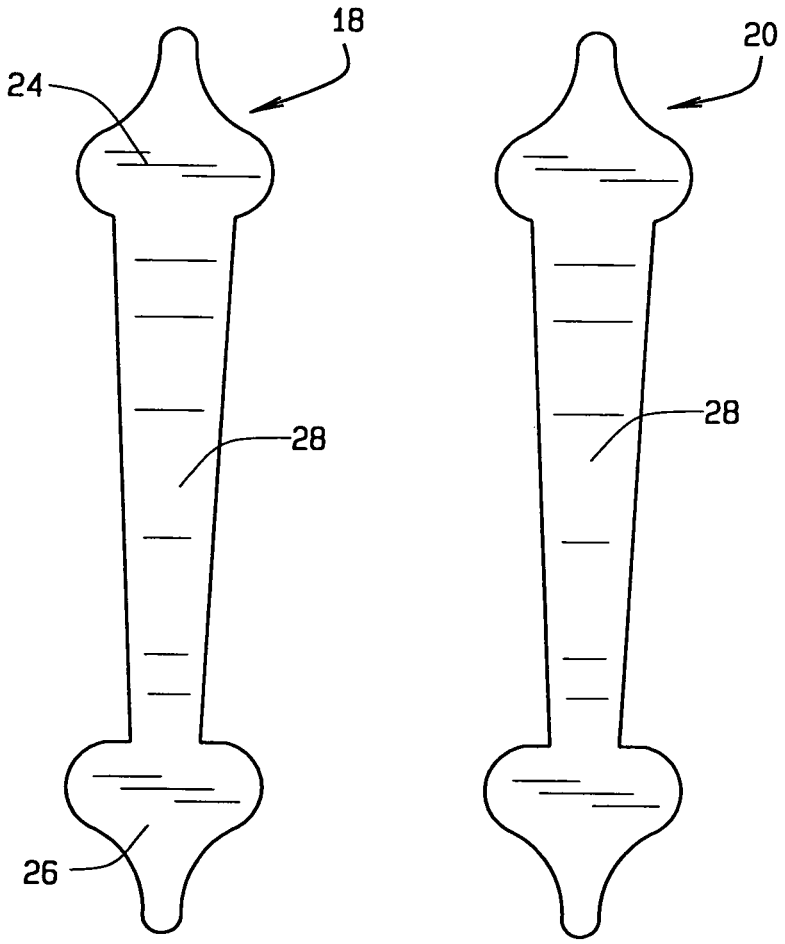
FIG. 3 shows the back sides of a plurality of the decorative handles.

In one aspect, decorative handles 18 and 20 comprise a flexible magnetic material such as 20 mil super hold magnetic doped vinyl sheeting. Any thickness that functions properly may be used. The sheeting can be die cut to or otherwise cut into the desired configuration of a handle. The magnetic vinyl holds the handle in a desired orientation upon the door by a strong magnetic bond. FIG. 3 illustrates one embodiment of a back side of handles 18 and 20. It will be noted that there is a stiffener layer 28 on the back side of the gripping section. In one aspect, stiffener layer 28 comprises a malleable material, such as light gauge aluminum. However, the stiffener layer could comprise any functional material such as metal, plastic, polystyrene, aluminum tape and so forth. Moreover, the malleable material could be incorporated inside the decorative handle and not applied as a separate external element or layer. In any event, the malleable material, or stiffener, allows the gripping area to retain its useful, raised configuration when the handle is bent to the desired shape.

Figure 4:
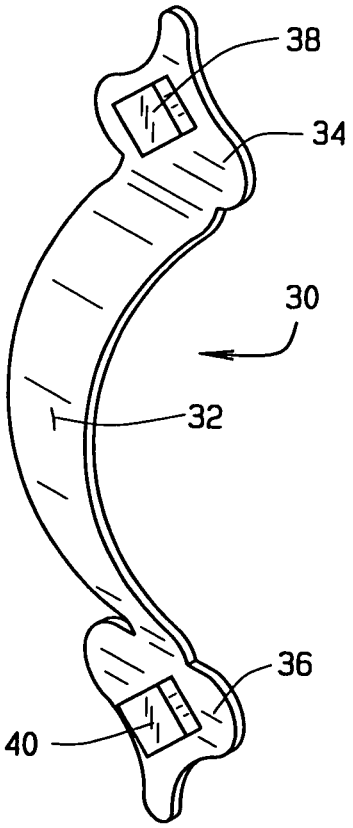
FIG. 4 is a front perspective view of another aspect of decorative handle.
Figure 5:
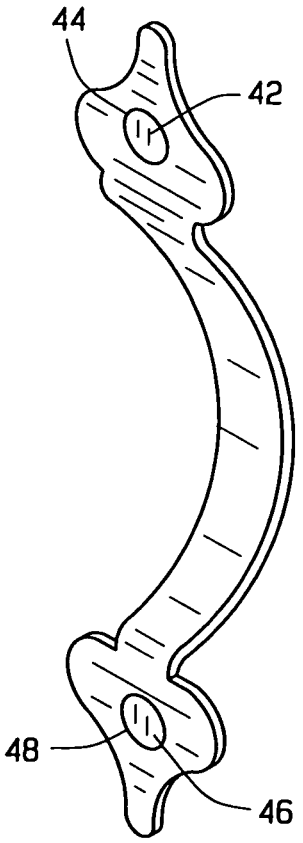
FIG. 5 is a rear perspective view of the decorative handle of FIG. 4.

FIGS. 4 and 5 illustrate another aspect of a decorative magnetic handle, indicated by number 30. Handle 30 is orientated such that its longitudinal axis extends vertically, however, it may be orientated such that its longitudinal axis extends laterally. Handle 30 generally has a central gripping portion 32 and a first decorative element 34 at the top and a second decorative element 36 at the bottom end. In the illustrated prior art, the decorative elements are spade shaped. Handle 30 includes additional ornamentation in the form of a raised faux bolt head 38 on the first decorative element and the second raised faux bolt head 40 on the second decorative element. The raised decorative elements may be of any design or configuration. The bolt head design is merely illustrative. It will be understood that the handle decorative elements and ornamentation configurations are illustrative of one aesthetically pleasing configuration and that any configuration of decorative elements may be employed.

As noted, the gripping section 32 is raised curves or arches. This arched configuration keeps the gripping section raised or elevated from the plane of the door and gives the handle a realistic, utilitarian look. The raised gripping section gives the appearance that a user could grasp the handle in a functional manner. It will be understood that the arched or curved configuration of the gripping section is but one choice. The gripping area could have sharp bends and appear essentially rectangular or any other desired configuration.

As best seen in FIG. 5, decorative handle 30 comprises a magnetic insert 42 positioned in a hole 44 formed in the first decorative end and a second magnetic insert 46 in a hole 48 in the back of a second decorative end. It will be noted that the faux bolt heads on the front surface of the handle allows the respective holes to be formed to a substantial material depth to seat the magnetic inserts. The inserts shown are circular, however, they can be any configuration or size. A magnetic insert at each end of the handle secures the handle to a metallic surface without movement or rotation.

While the elements 38 and 40 have been defined as faux bolt heads, which may connect or otherwise secure with the magnetic inserts 42 and 46, it is just as likely that these bolt heads and inserts may all be integrally formed of metal, and be magnetized, and can be molded through the apertures 42 and 48 of the decorative handle, so as to be integrally formed as partial bolts, located within the formed decorative handles, and the inserted portions 42 and 46 are readily available for securing to the metal surface of any garage, or other door, when installed.

As further previously reviewed, the decorative handles can be and preferably formed of a polymer, such as polypropylene, polystyrene, or any other related polymer that when molded provides a retainable form, such as the arcuate as shown for the various handles, so that when injected or otherwise molded, with the magnetic inserts in place, the entire handle is readily formed and available for retailing, and immediate installation, by the home or building owner.

Figure 6:
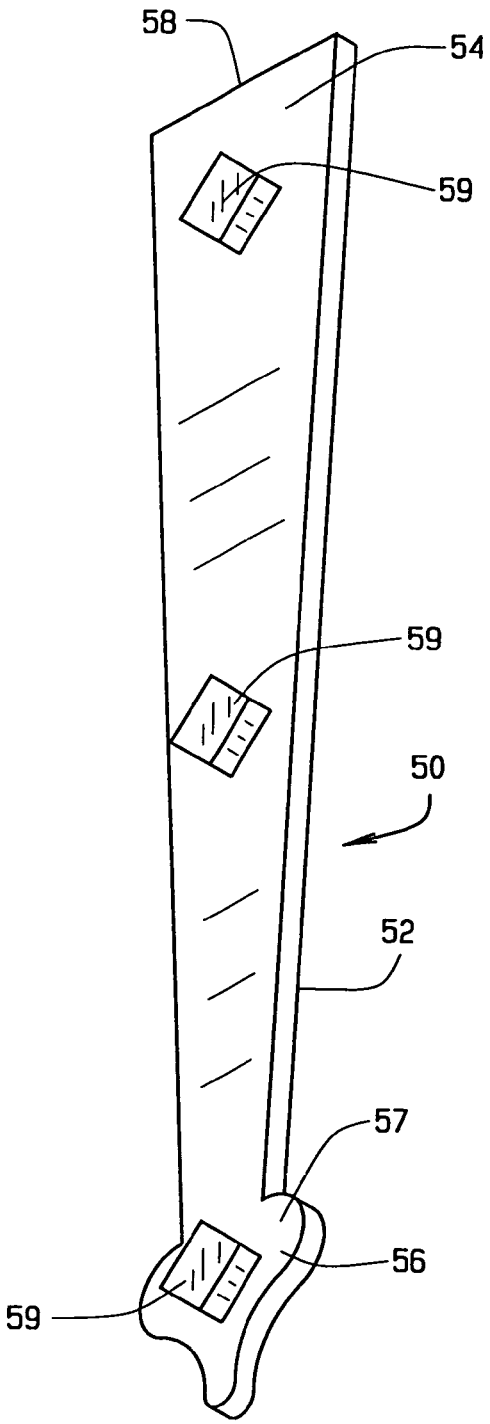
FIG. 6 is a front perspective view of an aspect of a decorative hinge element.
Figure 7:
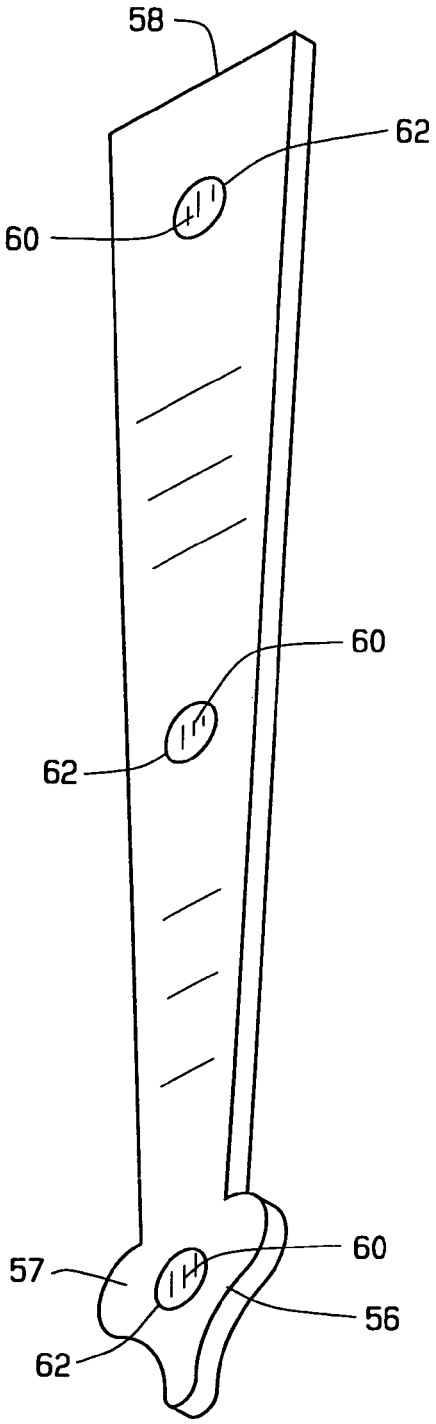
FIG. 7 is a rear perspective view of the decorative hinge element of FIG. 6.

FIGS. 6 and 7 illustrate an aspect of a decorative hinge element, indicated generally by number 50. Hinge element 50 has a peripheral configuration corresponding to an elongated hinge wing having an elongated, tapered body 52, a first end 54 and a second end 56 comprising a decorative element 57. First end 52, in the illustrated aspect, has a substantially flat edge 58 that would be positioned on one door panel in a vertical orientation adjacent the joint between two door panels. A second hinge element 50 or wing would be positioned on the adjacent door panel with the two flat edges 58 nearly in abutment when the door is closed, such that the two elements give the appearance of one elongated hinge spanning two adjacent door panels.

In any event, there is a plurality of raised decorated elements, in the illustrated aspect comprising three faux bolt heads 59 positioned along the length of the front surface of hinge element 50. As seen in FIG. 7, there is a plurality of magnetic inserts 60 in holes 62 formed in the back side of the element generally at the site of the raised faux bolt head. In the illustrated aspect, three magnetic elements function well, however, it will be understood that any number may be used to secure the hinge element on the surface of the metal door.

As with the handles described above, the configuration and choice of decorative elements is incidental and any desired configurations may be employed.

As previously explained with respect to the decorative handles, the decorative hinges or hinge elements likewise may have its faux bolt head elements 59 also formed of metal, and be integrally formed with the magnetic inserts 60, and be molded in place, within the polymer hinge, when it is formed, so that the magnetic surfaces of the inserts 60 are readily available for application to a garage or other door, when installed. In addition, as previously explained, the hinge elements themselves may be formed of a polymer, such as polypropylene, polystyrene, polyethylene, and have sufficient rigidity to maintain their lineal configuration and structure, when applied, and be resistant to any warping, or other distortion, when subjected over a lengthy period of time to incriminate weather conditions, both the heat and sun of summer, and the rain, snow and cold of winter.

Handle 32 and hinge element 50 may be constructed in any manner. One preferred method is to mold the pieces in a cavity mold, for example, out of a durable resin or plastic. The pieces can be molded with holds so that the finished pieces may be assembled by inserting and securing the magnetic inserts in the holes, for example with glue or other appropriate means.

It also would be acceptable to use substantially flat magnetic vinyl on the back of the molded handle 30 or hinge element 50 in place of the magnetic inserts. The magnetic material should be relatively flat so the pieces adhere smoothly to the surface of a metal door. Any other attachment means will suffice as well.

Also, although the decorative handles and hinge are primarily designed to attach to garage door, they can be attached to any door, such as a front door, a storm door or the like. The handle can be painted as desired.

It will be appreciated that the handle of the present invention can be formed in any desired size or configuration. Moreover, it can be used on any door to improve the look of the door.

I claim:

1. A faux decorative door handle for application to a metal garage door, comprising: a polymer material configured in the shape of an elongated door handle, said door handle having a front surface and a back surface, said door handle having an intermediate portion with a pair of ends, the intermediate portion of the door handle being molded into an arcuate configuration, resembling a raised gripping section, the ends being flattened, for application flush against any metal garage door, said molded door handle being molded into the configuration of a rigid curved portion having said ends, magnetic material incorporated in the handle ends that are capable of securing the handle ends to the surface of a metal door.

2. The decorative door handle of claim 1 wherein said door handle is formed of a molded resin.

3. The decorative door handle of claim 2 wherein the resin is a polymer.

4. The decorative door handle of claim 3 wherein the polymer is one of polypropylene, polystyrene, and polyethylene.

5. The decorative door handle of claim 1 and further comprising a faux bolt head integrally formed with each of the handle ends, and said faux bolt head being arranged and disposed upon the front surface of the ends of the door handle, to provide the appearance of a fastener for securement of the handle to the garage door during usage.

6. The decorative door handle of claim 5, wherein said decorative door handle including its arcuate portion and flattened ends are molded from a resin, said resin comprising a polymer, and being one of polypropylene, polystyrene, and polyethylene.

7. The decorative door handle of claim 6, wherein said door handle having a front-side, backside, and said ends, and a malleable stiffener material to maintain the handle in a desired three dimensional configuration, said malleable stiffener material being a thin layer of malleable metal applied on a backside of said handle at its arcuate portion to maintain said handle in its shaped configuration.

8. The decorative door handle of claim 1, wherein said magnetic material incorporated in the handle ends forms securing elements proximate said handle ends that are capable of securing to the surface of a door, and said securing elements comprising a pair of magnetic inserts, that are molded into each end of said door handle.

* * * * *